US005863187A

United States Patent [19]

Bensley et al.

[11] Patent Number: 5,863,187

[45] Date of Patent: Jan. 26, 1999

[54] TWO POSITION ROTARY RECIPROCATING PUMP WITH LIQUID DISPLACEMENT FLOW ADJUSTMENT

[75] Inventors: Douglas S. Bensley, Springfield, Vt.; Mark Tanny, Brownsville, Vt.

[73] Assignee: Ivek Corporation, North Springfield, Vt.

[21] Appl. No.: 797,330

[22] Filed: Feb. 10, 1997

[51] Int. Cl.[6] ..... F04B 49/00

[52] U.S. Cl. ..... 417/218; 417/238; 417/500

[58] Field of Search ..... 417/218, 238, 417/500

[56] References Cited

U.S. PATENT DOCUMENTS

| | | | |
|---|---|---|---|
| 3,168,872 | 2/1965 | Pinkerton | 417/500 |
| 3,512,178 | 5/1970 | Russell | 417/218 |
| 4,971,532 | 11/1990 | Slattery | 417/500 |
| 5,020,980 | 6/1991 | Pinkerton | 417/500 |
| 5,044,889 | 9/1991 | Pinkerton | 417/500 |
| 5,246,354 | 9/1993 | Pardinas | 417/500 |

*Primary Examiner*—Timothy Thorpe
*Assistant Examiner*—Cheryl J. Tyler
*Attorney, Agent, or Firm*—Sughrue, Mion, Zinn, Macpeak & Seas, PLLC

[57] ABSTRACT

A rotary reciprocating pumping apparatus is provided with a positive two position adjustment feature which allows the piston stroke to be increased to a maximum and repeatably, automatically, returned to a second calibrated dispensing position. Such rotary reciprocating pump is further provided with an adjustable liquid displacement velocity profile to maintain sufficient velocity of liquid flow at the end of the pump discharge cycle to enable injection of small volumes of liquid through a pump exhaust port, thereby eliminating the inaccurate and time consuming operation of touching off a small volume of liquid as a drop characterizing known rotary reciprocating pumping systems. A stabilizing ring of the cylindrical pump case is flush mounted within a counterbore of a pump mounting plate with one side of the ring directly abutting the bottom of the counterbore and a diametrically opposite side and abutting one or more standoffs to set the axis of the pump case and the pumping chamber at a slight angle in a transverse plane to the axis of the counterbore within the pump mounting plate, thereby modifying the pump piston liquid velocity profile to ensure significant fluid velocity at termination of the pump piston discharge stroke.

8 Claims, 7 Drawing Sheets

TWO POSITION ROTARY RECIPROCATING PUMP WITH LIQUID DISPLACEMENT FLOW ADJUSTMENT

FIELD OF THE INVENTION

This invention relates to rotary reciprocating piston pumps, and more particularly to a ceramic rotary reciprocating piston pump of modular form having capability of automatically returning the liquid displacement flow adjustment to an initial calibrated position after priming and/or cleaning.

BACKGROUND OF THE INVENTION

Precision liquid metering and dispensing apparatus in the field utilize various devices to meter liquids precisely in a dispensing process. Mechanisms used to meter liquids in microliter or milliliter quantities include time per pressure liquid displacement systems, positive liquid displacement pumps, peristaltic tubing pumps, and others. The positive displacement pump is known to be the most accurate and robust device for use in small volume dispensing applications.

There are various positive displacement devices which can be used to move and deposit liquids in a dispensing process. They include diaphragm pumps, piston pumps, gear pumps, syringe pumps and various other mechanisms. The ceramic rotary reciprocating piston pump is the mechanism which is the basis of this invention.

A ceramic rotary reciprocating piston pump offers several advantages over other positive displacement liquid dispensers. One of the advantages results from using the rotary motion of the piston with an integral valving feature to perform the valve function. This method of valving a pump is advantageous in that it eliminates peripheral valving mechanisms that can slow the cycling time of the pump or otherwise be a detriment to the pump's performance. Additionally, the use of a thermally and mechanically stable ceramic material in the construction of the piston and cylinder permits an extremely close running fit to be created thus eliminating the need for secondary seals. The resulting system offers excellent repeatability and long-term reliability as a result of its simplicity of design and limited use of moving parts.

Traditional displacement adjustment of a ceramic rotary reciprocating piston pump utilizes an angularly offset drive. This method allows the magnitude of the piston stroke to be changed by adjusting the relative angular relationship of the piston to the driving motor and its output spindle. U.S. Pat. No. 3,168,872 to H. E. Pinkerton issued Feb. 9, 1965 and entitled "POSITIVE DISPLACEMENT PISTON PUMP" is exemplary of a rotary reciprocating piston pump utilizing an angularly offset drive. The pump of this patent employs a ducted piston which reciprocates and rotates synchronously in a bi-ported cylinder. The piston duct is arranged to connect the ports alternately with the pumping chamber. One port communicates with the pumping chamber on the down stroke of the piston, while the other port is arranged to be exposed to the chamber on the piston upstroke. A piston-cylinder assembly is coupled to the output of a drive motor through an interposed collar or yoke. The piston includes at its outer end a laterally projecting arm having a ball bearing which is adapted to ride in a socket in the collar to thereby provide a universal joint between these parts. A cylinder conveniently receives the piston and is mounted on a bracket rotatable about a vertical axis. The cylinder is provided with at least one pair of ports both of which communicate with the cylinder pumping chamber. When the axis of the collar and that of the piston and cylinder are substantially coaxial, the piston does not reciprocate in the cylinder during the rotation of the collar. As such, no pumping action occurs. When the cylinder is angled about its pivot, the piston will reciprocate at an amount proportional to the angular displacement. The direction of rotation, that is either clockwise or counterclockwise determines the direction of fluid feed. The magnitude of the angular displacement of the piston and cylinder determines the amplitude of piston stroke and consequently flow rate. In a variation, the yoke rather than the cylinder is pivotal. In the past, the adjustment of the angular relationship of the piston to the driving motor and output spindle, collar or yoke is accomplished with a threaded mechanism such as a micrometer. It should be noted that in priming and purging of air from a liquid metering apparatus of this type maximizing the piston's stroke is advantageous. In addition, a long piston stroke provides increased liquid turbulence within the pumping chamber, a proven benefit for clean in place systems. In order to achieve a long piston stroke, the angular relationship of the piston to the drive spindle must be increased to its maximum limit. After successfully priming or cleaning the pumping apparatus, a time consuming adjustment and calibration procedure is required to restore the pump's output to a desired volumetric displacement.

Traditional rotary reciprocating pump designs accelerate the liquids they are displacing in a manner fixed by the mechanical relationship of the pump to the drive motor and spindle. The displacement of liquid by the piston is a cosine function with the velocity of the liquid at the beginning and end of the intake and discharge strokes being zero. As a result of this velocity profile, the pumping apparatus is unable to eject small volumes of liquid from the dispensing tip.

It is therefore the primary object of the present invention to provide a rotary reciprocating pumping apparatus with a positive two position adjustment feature which will allow the piston's stroke to be preferably automatically increased to a maximum and repeatably, preferably automatically returned to a second, calibrated dispensing position, thereby eliminating time consuming adjustments required with traditional rotary reciprocating pump designs.

An additional object of the invention is to provide such rotary reciprocating pumping apparatus with an adjustable liquid displacement velocity profile to achieve an increase in the velocity of the liquid at the end of the pump's discharge cycle to enable ejection of small amounts of liquid from a dispensing tip, thereby eliminating the inaccurate and time consuming operation of "touching off" a small volume drop of liquid characterizing known pumping systems.

It is a further object of the invention to provide a rotary reciprocating pump having enhanced fluid performance with increased ease of use during pump priming and cleaning.

Other objects and advantages will become apparent from the following detailed description which is to be taken in conjunction with the accompanying drawings illustrating a preferred embodiment of the invention.

DESCRIPTION OF THE PREFERRED EMBODIMENT

Figure 1:
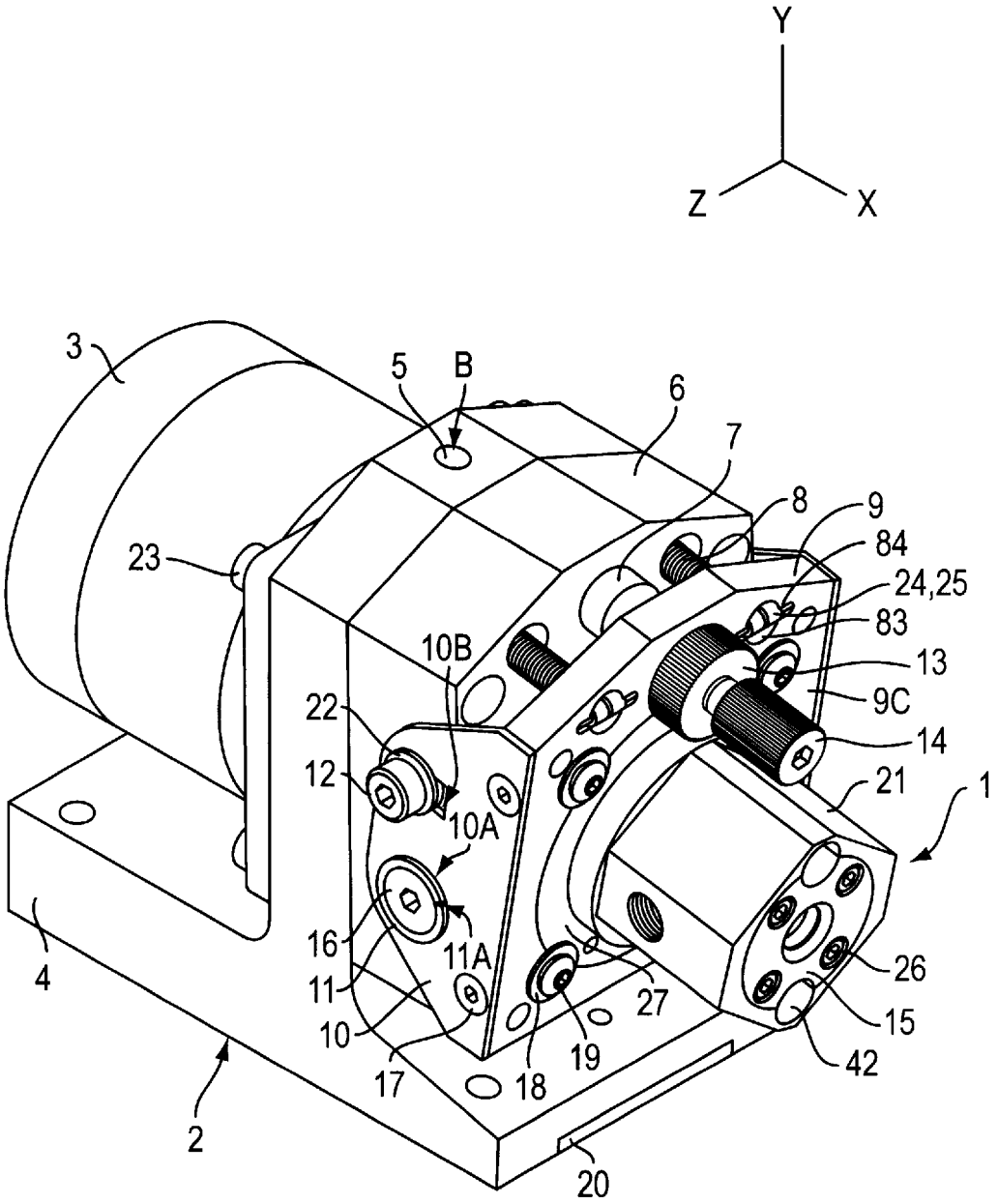
FIG. 1 is a perspective view of a rotary reciprocating pumping apparatus forming a preferred embodiment of the invention.
Figure 2:
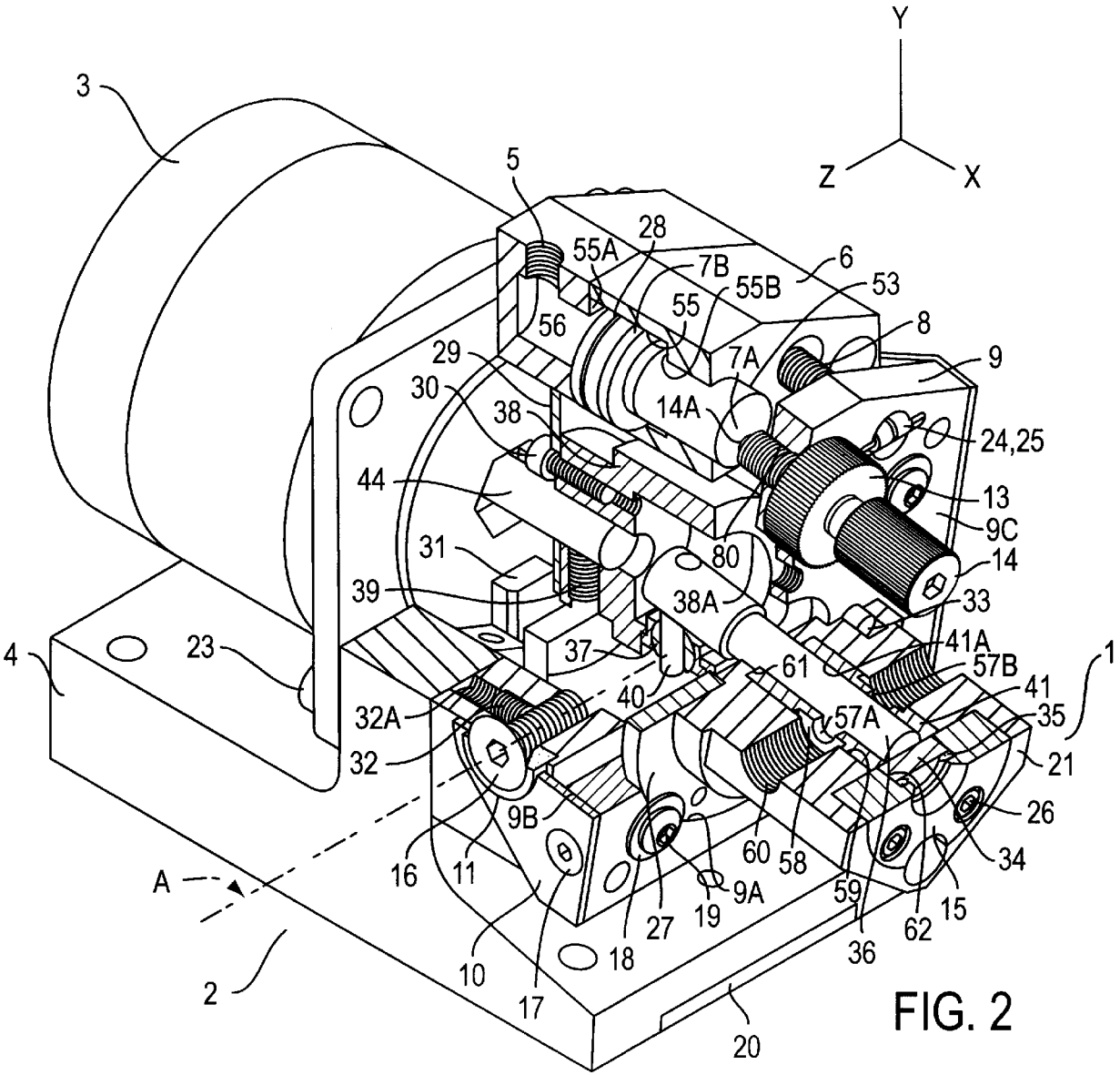
FIG. 2 is a perspective view of the pumping apparatus of FIG. 1, partially in section, showing the internal components thereof.

Referring to FIGS. 1 and 2, a positive displacement piston pump module forming a preferred embodiment of this invention is shown mounted to a motor and base assembly indicated generally at 2. The motor and base assembly 2 is composed of a suitable inverted T-shaped base bracket 4, to which is attached a drive motor 3, a mounting block 6, and an integral magnet hall effect vane sensor 31.

Figure 3:
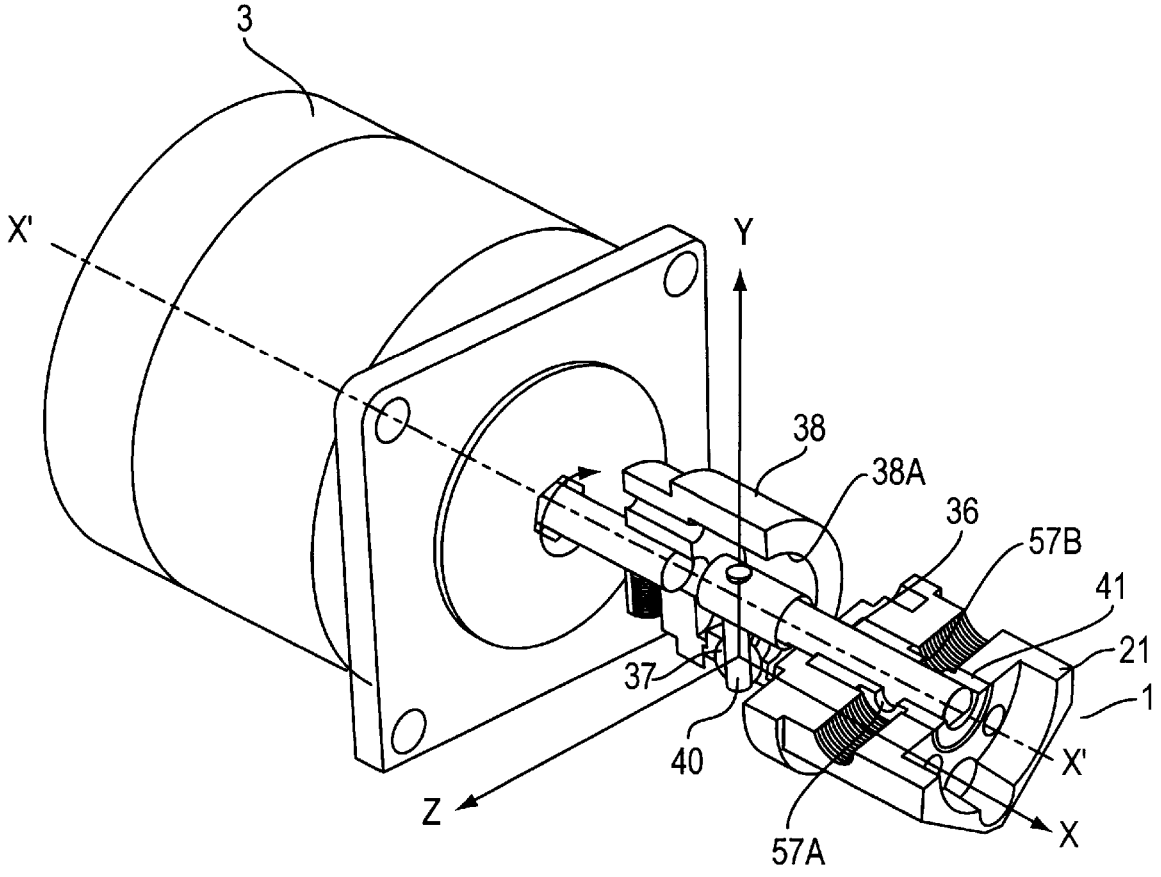
FIG. 3 is a perspective view of the pumping apparatus of FIG. 1, partially in section, showing the pumping module coupled with the drive spindle and motor.

A drive spindle assembly is composed of a spherical bearing 37, fixedly installed in a radial bore 38A, FIG. 3, of a cylindrical spindle hub 38, and a slotted rotary vane 29 is attached to a reduced diameter boss extending concentrically from the spindle hub 38 via three socket head cap screws 30. The drive spindle assembly is attached to the motor output shaft 44 and secured in place by means of a set screw 39.

Two radially slotted conical pivot bearings 11, one as shown and one (not shown) on a side opposite thereto, are positioned and aligned coaxially with the spherical bearing 37, with the spherical bearing 37 being positioned as shown in FIG. 2. The slotted conical pivot bearings 11 include a narrow radial slot 11A over the axial length thereof, and are thus free to expand and contract radially, are attached to the mounting block 6 with flat head screws 16 which in turn are torqued to expand the radial pivot bearings 11 thereby creating a shake free rotary fit with the surrounding axially aligned bores 10A of the respective side plates 10. The flat head screws 16 are locked in place axially with right angle set screws 32 in tapped bores 32A, after the torque adjustment is made.

The two side plates 10, one as shown and one (not shown) on the side opposite, pivotably mount the pivot bearings 11 and are fixed, respectively, to respective opposite edges 9B of a pump mounting plate 9 with flat head socket cap screws 17. The pump mounting plate 9 on bearing 11 is tiltably adjusted away from the vertical face of mounting block 6 via a fine thread, spherical end thumb screw 14 inserted through a similarly threaded tapped hole 80 in the pump mounting plate 9, with spherical end 14A resting in contact with end 7A of adjustment piston 7. The thumb screw 14 is locked in this calibrated position with a thumb nut 13, threadably mounted on the external threads of thumb screw 14. Tension springs 8, FIG. 1, affixed at one end to the mounting block 6 and at the opposite end to the pump mounting plate 9 provide a biasing force which holds the spherical end 14A of the thumb screw in contact with the end surface 7A of the adjustment piston 7. Loops on the tension springs 8 have transverse small diameter pins 24 passing therethrough, the pins 24 carrying a pair of short length cylinders 25 which fit within a circular recess 83, FIG. 1, to opposite sides of the end loop of each spring 8 to maintain the springs centered. The ends of the pins are received within a longitudinal groove 84 within the front face 9C of the pump mounting plate 9. Each of the tension springs 8 to opposite sides of the thumb screw 14 are so mounted.

The adjustment piston 7, FIG. 2, is stepped with an integral enlarged diameter portion 7B having an annular groove machined into the periphery thereof, fitted with an appropriate elastomeric seal 28. The adjustment piston 7 and seal 28 assembly is slidably fitted into a smooth cylindrical bore 53 and counterbore 55 within mounting block 6. The bore is counterbored at 55 over a given length to an appropriate diameter allowing the seal 28 to create a sliding seal between the adjustment piston 7, radially enlarged piston 7B and the mounting block counterbore 55 and the counterbore 55 terminates in radial shoulders 55A and 55B. Provided in the base bracket 4 and located coaxially with the adjustment piston 7, is a cylindrical chamber 56 with a port hole 5 extending through and to the outer surface of the base bracket 4. Pressurization of this chamber with compressed air, as per arrow B, causes the adjustment piston 7 to be pushed forward, to the right in FIG. 2, in the direction of shoulder 55B, tilting the pump mounting plate 9 about pivot axis A through the center of the flat head screws 16, which in turn positions the piston pump module indicated generally at 1 for maximum piston stroke displacement determined by the length of slots 10B in side plates 10 and the diameter of the shank portions of screws 12. When the chamber 56 is depressurized and the compressed air vented to the atmosphere, the pump mounting plate 9 is pulled back to its calibrated position, to the left in FIG. 2, with the adjusting piston radially enlarged portion 7B abutting shoulder 55A, by the two tension springs 8 which in turn push the adjusting piston 7 back to its maximum retracted position via the spherical end 14A of thumb screw 14.

A stabilizing ring 27 is fitted into a cylindrical counterbore 9A in the face 9C of the pump mounting plate 9 and clamped in place with four circumferentially spaced button head cap screws 19. The stabilizing ring 27 may be angularly positioned about its axis so that its axis is coincident with the axis of the bore and counterbore 9A within pump mounting plate 9. Additionally, the stabilizing ring 27 may be mounted at a predetermined angle to the axis of the aligned pivot bearings 11 to create a predetermined, modified piston displacement velocity profile such as that graphically illustrated at E in FIG. 8.

Two socket head shoulder screws 12, one as shown in FIG. 1 and one on the side opposite, are inserted through slots 10B in the side plates 10, FIG. 1, and threadably attached to the mounting block 6. These shoulder screws serve two functions. First, the shoulder screws 12 provide a feature which limits the angular tilt of the pump mounting plate 9 depending on the length of the slots 10B within side plates 10, through which the shanks of screws 12 pass, in this embodiment 10, when the pump mounting plate 9 is pivoted around the aligned axes A of the pivot bearings 11. Secondly, when the shoulder screws 12 are torqued down, they clamp the side plates to the mounting block 6, thus locking the pumping apparatus in its calibrated position.

As best seen in FIG. 2, the piston pump module, indicated generally at 1, is composed of a pump case 21, a ceramic cylinder 41 carried thereby, an end cap 34, an O-ring 35, an end cap retainer 15, and a ceramic piston 36. The ceramic cylinder 41 is provided with an axial bore 41A which slidably, concentrically, sealably and rotatably carries the piston 36. Additionally, diametrically opposed, small diameter radial passages are formed within the cylinder 41 terminating at flats 58 on the peripheral surface of the ceramic cylinder 41 defining an intake port 57A and a discharge port 57B for the pump. The pump case 21 is provided with an axial counterbore 59 into which the ceramic cylinder 41 is mounted. Threaded, diametrically opposed radial passages 60 to which the intake and discharged ports of the cylinder open are formed within the pump case 21. The ceramic cylinder 41 abuts a shoulder 61 at one end of the counter bore 59, and is closed off by an end cap 34 at the opposite end. The end cap 34 is received within a counterbored recess 62 in the end cap retainer 15 which retainer is held in abutment with the pump case by four screws 26. An O-ring 35 abuts a shoulder at the bottom of a counterbored recess 62 in the end cap retainer 15 and is compressed against the end cap 34 thereby providing the force required to sealably hold the end cap 34 in contact with the end of the ceramic cylinder 41. Liquid supply and discharge tube flanges are sealably connected to the ceramic cylinder 41 by compression fittings (not shown) threaded into the radial passages 60 of the pump case 21.

A laterally projecting drive pin 40 secured to one end of the piston 36 is slidably inserted into the bore of the spherical bearing 37, and the pump module, indicated generally at 1, is mounted to the stabilizing ring 27 with two socket head cap screws, indicated generally at 42, FIG. 1. A reduced diameter boss extends concentrically from the pump case 21 and provides coaxial alignment of the pump module 1 to the drive shaft 44 of the motor 3 when the pump module 1 is inserted into the inner bore of the stabilizing ring 27. A pin 33 affixed to and protruding from the surface of the stabilizing ring 27 ensures the proper angular orientation of the pump module's intake and discharge ports 57A, 57B, respectively.

Figure 4:
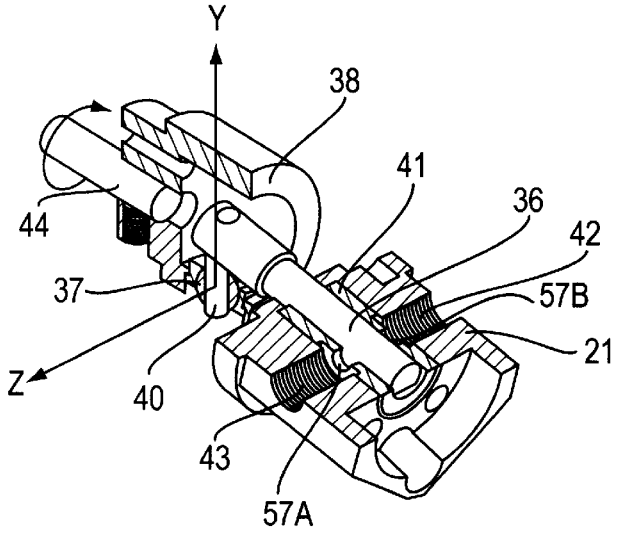
FIG. 4 is a perspective view, partially in section, of the pumping module of FIG. 3, coupled to the drive spindle and angularly oblique thereto similar to that of FIG. 2.

Referring now to FIG. 3, similar to U.S. Pat. No. 3,168,872 with the piston 36 in a coaxial relationship with the spindle hub 38, the piston will not reciprocate when the motor 3 rotates the spindle hub. With the pumping apparatus in such alignment, no pumping action takes place. Referring to FIG. 4, when the piston pump module is pivoted negatively about axis z, which is coaxial with the pivot bearings 11 (FIGS. 1 and 2), the pump piston 36 will be pivoted in a like manner. Assuming the depicted rotation of the motor shaft 44, the path of travel of the spherical bearing 37, and the resultant reciprocation of the piston 36 will cause fluid to be taken into the pumping chamber through inlet or intake port 57A and to be discharged from the chamber through outlet or discharge port 57B.

Figure 5:
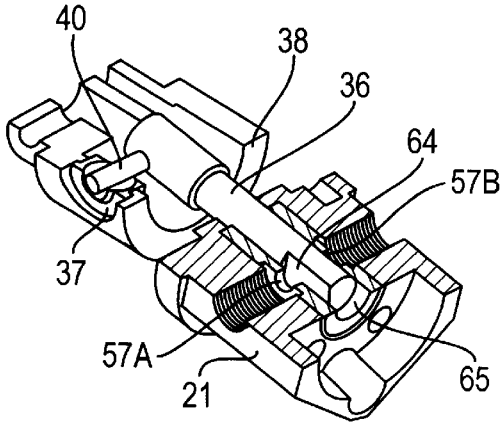
FIG. 5 is a perspective view of the pumping module of FIG. 4 with the drive spindle rotated and the piston slightly retracted from the condition of FIG. 4.
Figure 6:
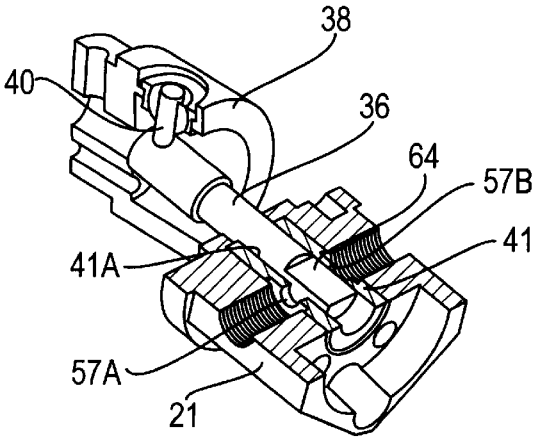
FIG. 6 is a perspective view of the pumping module with the drive spindle further rotated clockwise from that of FIG. 5 and with the piston in full retracted position within the cylinder.
Figure 7:
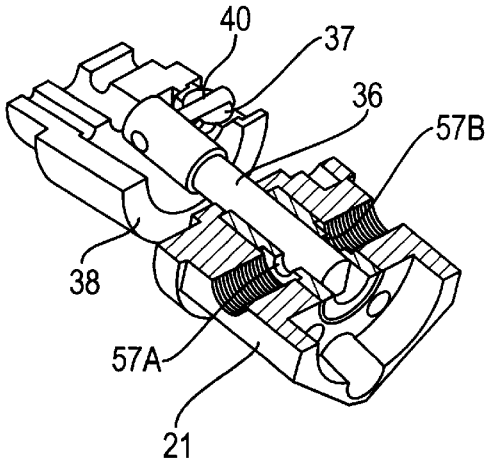
FIG. 7 is a similar perspective view to that of FIG. 6 with the piston further rotated clockwise and extended axially within the cylinder and completing a pumping discharge stroke of the pumping cycle.

FIGS. 4–7 illustrate the cycle of operation of the pumping apparatus when positioned as previously described. In FIG. 4, the piston 36 will be at the end of its forward stroke with both the intake 57A and the discharge 57B ports sealed isolating the pumping chamber from the liquid circuit. As the spindle hub 38 rotates in a counterclockwise direction from motor 3 end, a flatted area 64 on the forward end of the piston 36 will rotate in a like manner opening the pumping chamber 65 to the intake port 57A as the piston 36 is retracted through its intake stroke. FIG. 5 shows the spindle hub 38 rotated 90° counterclockwise, viewed from motor 3, and as a result the piston 36 is positioned one half way through its intake stroke. When the spindle hub 38 and piston 36 rotate to the position illustrated in FIG. 6, the pump piston 36 is at its fully retracted position and both the intake 57A and discharge 57B ports are sealed, isolating the pumping chamber 65, defined by piston 36 and the bore 41A within ceramic cylinder 41, FIG. 6, from the liquid circuit. Continuing to rotate the spindle hub 38 and piston 36 in a counterclockwise direction will bring the flatted area of the piston 36 into communication with the discharge port 57B while the piston 36 extends through its discharge stroke, the chamber 65 decreasing in volume. FIG. 7 shows the piston 36 positioned one half of the way through its discharge stroke.

The present invention is directed to a rotary reciprocating liquid dispensing pump provided with an adjustment mechanism to alter the pump piston displacement profile to ensure that the pumped liquid is moving at significant velocity during pump liquid discharge.

Figure 9:
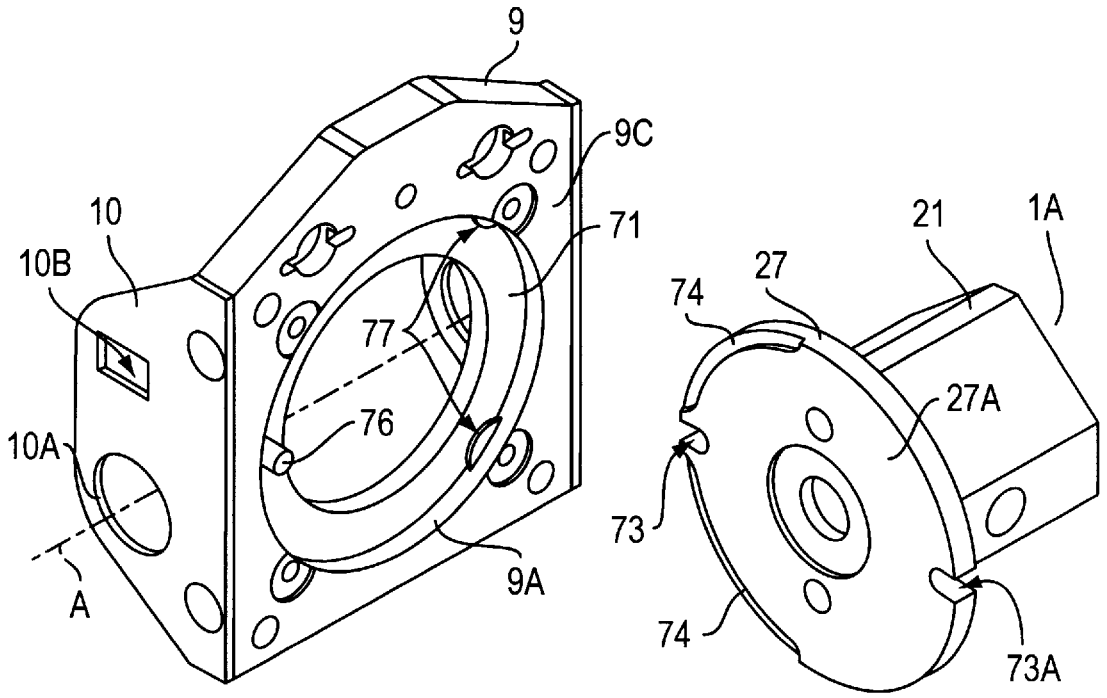
FIG. 9 is an exploded view of the pump module stabilizing ring assembly and the pump mounting plate of the rotary reciprocating pumping apparatus of FIG. 1, illustrating the mechanism for achieving modification of the velocity profile of the piston pump.
Figure 10:
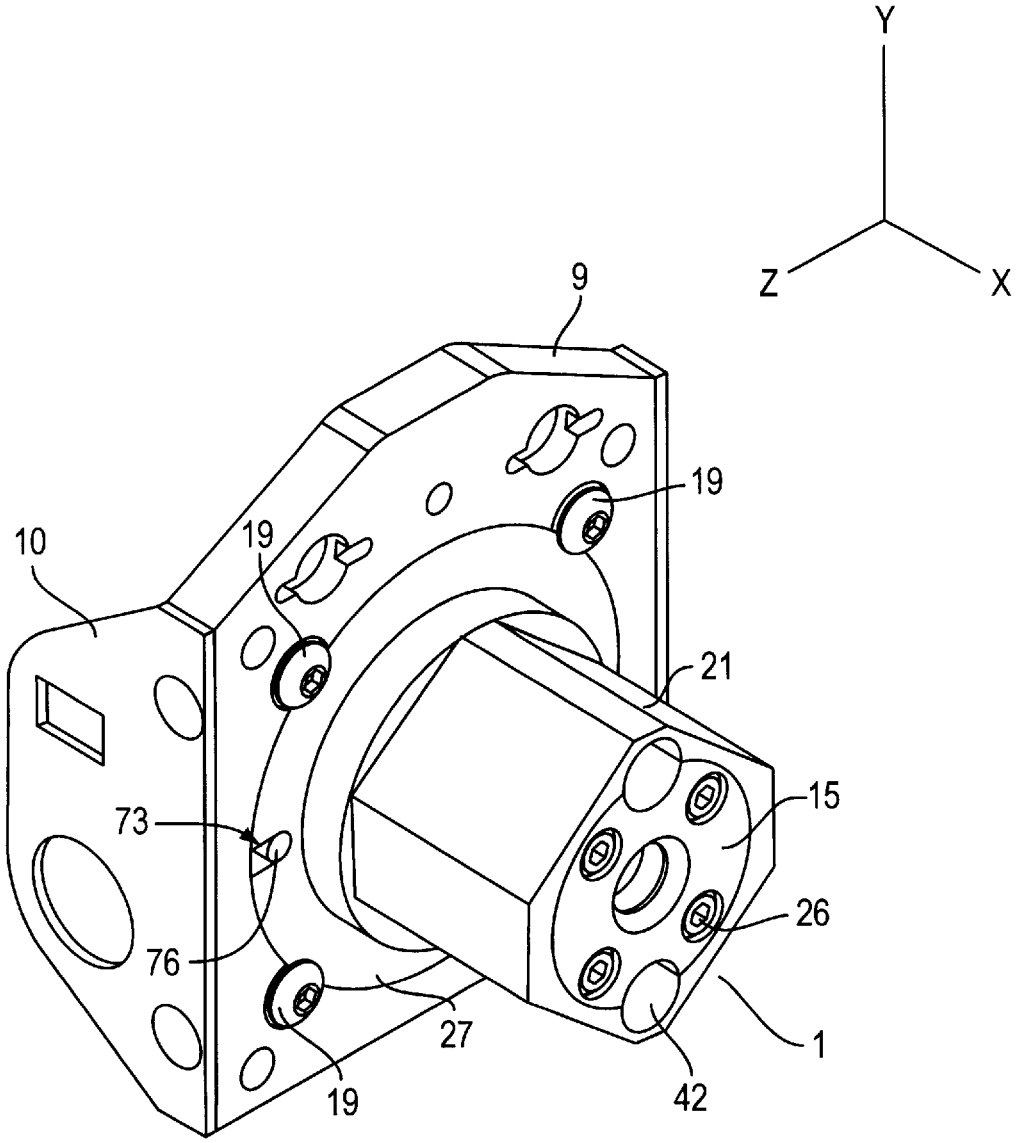
FIG. 10 is a perspective view of the pump module stabilizing ring assembly coupled to the pump mounting plate under conditions in which the pumping apparatus has a modified velocity profile of the piston pump, as illustrated by curve E of FIG. 8.

Referring to FIG. 10, the pumps' ceramic cylinder is fixedly assembled into a bore 59, FIG. 2, in the pump case 21, and the end of the cylinder is closed off by an end cap 34, FIG. 2, held in place by an end cap retainer 15, referred to as the pump module 1 in all figures. In turn, this pump module is fixedly attached to a stabilizing ring 27 with socket head cap screws 42, defining a pump module stabilizing ring assembly 1A, FIG. 9.

In the exploded perspective view of FIG. 9, pump mounting plate 9 has a cylindrically counterbored recess 9A centrally located in its face 9C. The pump mounting plate 9 has two circumferentially spaced, raised, sector shaped bosses 77 located on the bottom surface 71 of the cylindrically counterbored recess 9A. Additionally, a cylindrical locating pin 76 protrudes outwardly from the same bottom surface 71 of recess 9A.

In FIG. 9, certain machined in features in the stabilizing ring 27 include a mouse hole shaped notch indicated at 73 within face 27A, radially inwardly of the periphery and diametrically opposed thereto, a second mouse hole shaped notch 73A, two circumferentially spaced, arc shaped corner relief peripheral recesses indicated at 74 to opposite sides of notch 73.

The rotary reciprocating liquid dispensing pump of this invention further includes certain features to allow the pumping mechanism to be assembled in a manner so as to alter the profile of the normal liquid flow velocity curve enabling small liquid volumes to be ejected from the dispense tip at relatively high velocity, the tip being at the outlet end of a tube or the like connected directly to the discharge port of the pump.

Referring again to FIG. 10, the pump module stabilizing ring assembly 1A, FIG. 9, is fitted into the cylindrical counterbore 9A in the face 9C of the pump mounting plate 9 and is clamped in position with four button head cap screws 19, threadably carried by plate 9, FIG. 10. When stabilizing ring 27 is mounted into the pump mounting plate in the orientation shown, the two arc shaped corner relief recesses 74 provide for clearance of the stabilizing ring around the two raised bosses 77 in the bottom 71 of the counterbored recess 9A of the pump mounting plate 9, such that flat face 27A of stabilizing ring 27 lies flush against the bottom 71 of counterbore recess 9A, with notch 73A receiving pin 76.

Figure 8:
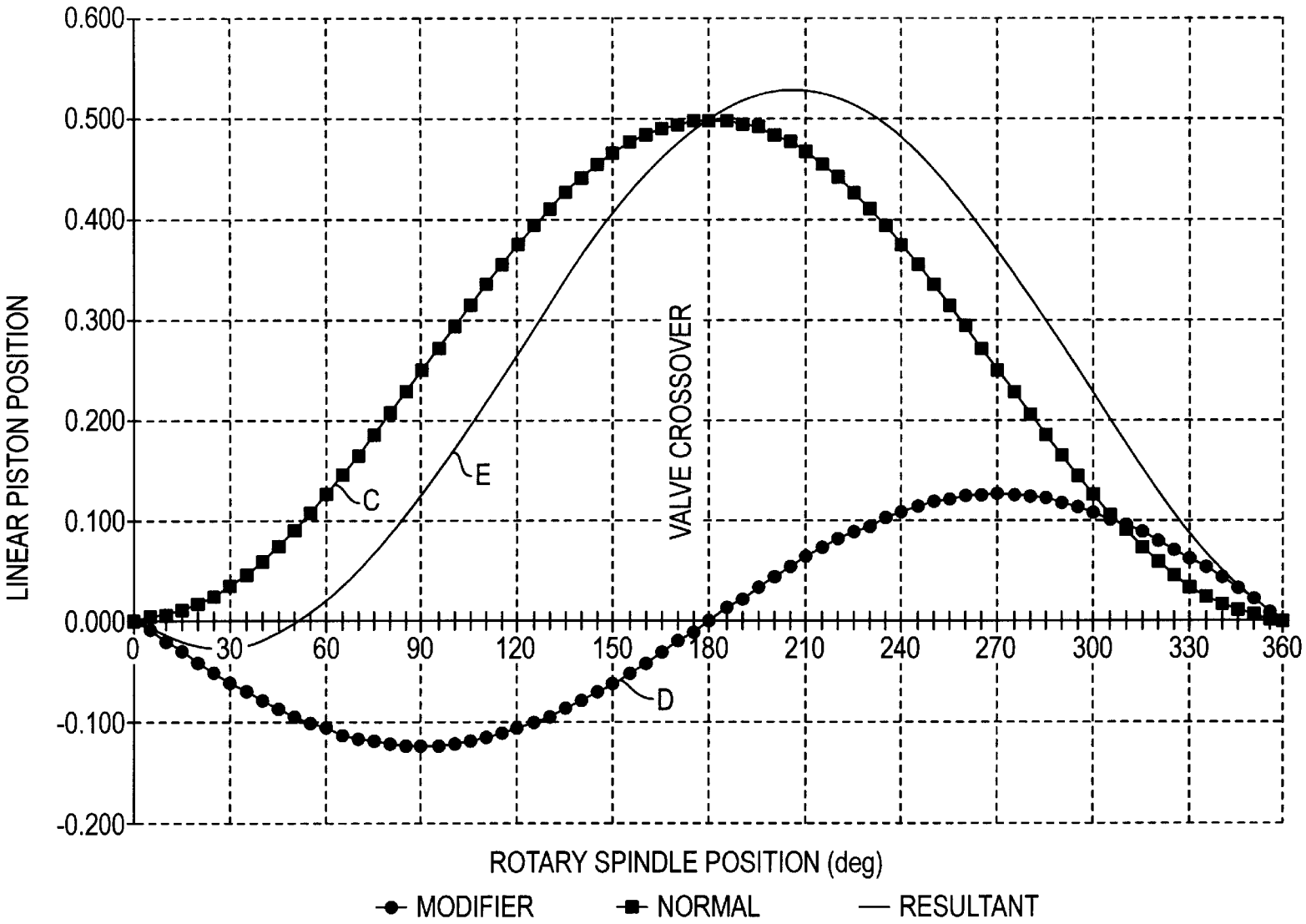
FIG. 8 is a graph of piston displacement velocity profile of the piston pump of the pumping apparatus of FIG. 1 superimposed by a displacement velocity profile to modify the normal displacement velocity and the resultant velocity profile effected by such modification.

With the pump module stabilizing ring assembly 1A mounted to the pump mounting plate 9 as per FIG. 9, the pump module 1 operates in accordance with curve C, FIG. 8, and the velocity of the pump liquid at valve cross over is zero. Referring to FIG. 10, the four button head cap screws 19 may be loosened to release the clamping pressure they exert on stabilizing ring 27. Once screws 19 have been loosened, the pump module stabilizing ring assembly 1A can be rotated 180° in either direction and notch 73 may be positioned to receive pin 76.

Referring now to FIG. 10, the mouse hole shaped notch 73 through the stabilizing ring 27 functions in the position of assembly 1A as a keying feature which closely surrounds the cylindrical locating pin 76 protruding from the recessed bottom surface 71 of the pump mounting plate 9. This is after the assembly 1A is first rotated 180° from that of FIG. 9 to that of FIG. 10. The pump module stabilizing ring assembly 1A oriented as shown is then fitted into the cylindrically counterbored recess 9A in the pump mounting plate 9. With the pump module stabilizing ring assembly 1A mounted into the pump mounting plate 9 as shown, the rear or back surface 27A of the stabilizing ring 27 to the side opposite the locating pin 76 is supported by the two raised bosses 77. Raising one side of the stabilizing ring laterally of the axis of the pump assembly serves to tilt the entire pump module stabilizing ring assembly 1A along the X and Z plane, FIG. 3, approximately 0.70 about a displaced axis y at the contact point of the stabilizing ring's outer periphery with the counterbore of the pump mounting plate 9 in the illustrated embodiment. Once raising is achieved, the stabilizing ring 27 is clamped in position in the same fashion against the bottom 71 of counterbore 9A within pump mounting plate 9 as that previously described with respect to the orientation and arrangement of FIGS. 9 and 10 by screwing down the four button head screws 19. Mounting the pump module 1A in this angled position serves to create a piston displacement modifier curve D graphically depicted in FIG. 8. When this modifier curve D is added to the normal displacement curve C, a resultant curve E with a higher flow velocity at the time of valve closure is produced. Closing the discharge valve at the end of the discharge stroke and stopping the flow of liquid when the liquid is at this higher velocity produces a liquid shear required at the dispense tip coupled to exhaust port 57B to eject controlled, set, very small volumes of liquid, thereby enhancing speed of dispensing, while ensuring repeated accurately dispensed microliter sized liquid volumes.

The pump stabilizing ring can be adjusted to achieve the resultant curve E of FIG. 8 through other methods. For example, the lateral tilt of the pumping module stabilizing ring assembly 1A (approximately 0.7°) can be achieved by machining surfaces of the bottom 71 of counter bore 9A and face 27A of stabilizing ring 27 with a 0.35° angle along the X and Z plane with respect to the axis x of the pump module. When the pump module stabilizing ring assembly 1A is mounted to place 9 as described in FIG. 9, these two angled surfaces will offset one another to achieve the normal displacement depicted by curve C in FIG. 8. When stabilizing ring assembly 1A is rotated 180° from that of FIG. 9, the 0.35° angles will combine to produce the 0.7° displaced axis and the resultant curve E as depicted in FIG. 8. Yet another method to achieve the resultant curve E of FIG. 8 is to mount motor 3 of FIG. 1 at a 0.7° angle along the X and Z plane with respect to the axis x of the pump module.

While the description above is to a preferred embodiment and contains specific parameters and connection details, these should not be construed as limitations on the scope of the invention and the system in the various figures is exemplary only. The scope of the invention is determined not by the illustrated embodiment, but by the appended claims and their legal equivalents. As may be further appreciated, various changes may be made to the pump, the pumps being of modular form may be incorporated in a structural assembly of several or more pumps operating under similar principles, but having cyclic pump cycle variations with different modified displacement velocity profiles keyed to repetitive, high speed accurate ejection dispensing of microliter sized volumes of liquid at the discharge port of the pump and thus at the dispense tip at relatively high liquid velocity.

What is claimed is:

1. In a rotary reciprocating liquid dispensing pump comprising:

a pump mounting block, a pump mounting plate movably mounted to said pump mounting block for movement towards and away from said pump mounting block, a pump case, a cylindrical cavity within said pump case having a first axis (x), means within said pump case defining a liquid intake port and a liquid exhaust port opening to said cylindrical cavity, a pump piston sized to be coaxially, sealably positioned within said cylindrical cavity of said pump case and forming with said cylindrical cavity a pump chamber;

duct means on said piston for transfer of pump liquid from said intake port to said exhaust port through said pump chamber, means for fixedly mounting said pump case to said pump mounting plate for movement of said pump case with said pump mounting plate towards and away from said pump mounting block, a drive motor mounted to said pump mounting block on a face thereof opposite to that supporting said pump mounting plate;

said drive motor including a motor rotary output shaft;

a cylindrical spindle hub fixedly carried by said shaft and surrounding said shaft, means for coupling said pump piston to said motor shaft via actuator means for reciprocating said pump piston upon operating of said drive motor through said coupling means such that said liquid intake and liquid exhaust ports are cyclically opened and closed by said pump piston;

means for limiting movement of said pump mounting plate between zero piston stroke and full piston stroke positions within said cylindrical cavity;

adjustable means for setting pump piston displacement to a pump calibrated position intermediate of zero and full piston stroke positions for pumping a given volume of liquid for each cyclic piston stroke;

the improvement further comprising:

means for biasing said pump mounting plate towards zero pump piston stroke position; and adjustable means operatively coupled to said movable pump mounting plate for automatic repeatable driving of said movable mounting plate and said pump piston to said pump calibrated position against said biasing means, thereby allowing the pump piston stroke to be increased to a maximum and repeatably automatically returned to said pump calibrated dispensing position, thereby eliminating time consuming adjustments of said adjustable means for setting pump piston displacement required by known rotary reciprocating pump designs.

2. The rotary reciprocating liquid dispensing pump as claimed in claim 1, wherein said adjustable means for setting pump piston displacement to said pump calibrated position comprises an axially adjustable thumb screw mounted to said pump mounting plate with a screw shank projecting from a face of the pump mounting plate proximate to said pump mounting block, and an axially adjustable fluid driven piston mounted to said pump mounting block for movement along the axis of said adjustable piston aligned with the axis of said thumb screw and forming an abutment to limit movement of said thumb screw and said pump mounting plate in the direction of said pump mounting block by said biasing means.

3. The rotary reciprocating liquid dispensing pump as claimed in claim 2, wherein said biasing means comprises at least one tension spring coupled at one end to said pump mounting block, and at another end to said pump mounting plate.

4. The rotary reciprocating liquid dispensing pump as claimed in claim 2, wherein said pump mounting block comprises an axial bore extending generally parallel to the axis of said motor shaft, inwardly from a face of said pump mounting block proximate to and facing said pump mounting plate towards an end of said pump mounting block opposite that of said pump mounting plate and terminating short thereof, said pump mounting block axial bore including a counterbore portion extending over a length of said bore and intermediate of ends thereof, said adjustment piston including a radially enlarged portion over a length of the same having a width less than that of said counterbore and being positioned therein, said counterbore defining axially spaced shoulders to respective opposite sides of said radially enlarged portion of said adjustment piston and forming with said bore within said mounting block remote from said pump mounting plate, a gas pressure chamber and means for supplying gas under pressure to said gas pressure chamber for driving said adjustment piston against the shoulder of said counterbore proximate to said pump mounting plate to the extent of abutment of said radially enlarged portion of said adjustment piston impacting one of said shoulders proximate to said pump mounting plate, thereby driving the thumb screw and said pump mounting plate against the biasing means to said pump maximum displacement position.

5. In a rotary reciprocating liquid dispensing pump comprising:

a pump mounting block, a pump mounting plate movably mounted to said pump mounting block for movement towards and away from said pump mounting block, a pump case, a cylindrical cavity within said pump case having a first axis (x), means within said pump case defining circumferentially spaced liquid intake and liquid exhaust ports opening to said cylindrical cavity, a pump piston sized to be coaxially slidably positioned within said cylindrical cavity for reciprocation along said first axis and forming with said cylindrical cavity a pump chamber, duct means on the pump piston exterior for transfer of pump liquid from said intake port to said exhaust port through said pump chamber, means for fixedly mounting said case to said pump mounting plate for movement of said pump case with said pump mounting plate towards and away from said pump mounting block, a drive motor mounted to said pump mounting block on a face thereof opposite to that supporting said pump mounting plate, said drive motor including a motor rotary output shaft, a cylindrical spindle hub fixedly carried by said shaft and surrounding said shaft, means for coupling said pump piston to said motor shaft via actuator means for reciprocating said pump piston along said first axis (x) upon operating said drive motor through said coupling means, such that said liquid intake and liquid exhaust ports are cyclically opened and closed by said pump piston, with said first axis (x) and the axis of the motor rotary output shaft being angularly offset and defining a first plane and means for tilting said pump case along a second plane at right angles to said first plane and about an orthogonal axis (y) at right angles to said second plane at a contact point of the outer periphery of the pump case with said pump mounting plate to cause a modification of the pump piston liquid displacement velocity profile to maintain sufficient velocity of the pump liquid at the end of the pump discharge cycle to enable ejection of small volumes of liquid from the pump exhaust port, thereby eliminating an inaccurate and time consuming operation of touching off a small volume of liquid as a drop characterizing known rotary reciprocating pumps.

6. The rotary reciprocating liquid dispensing pump as claimed in claim 5, wherein the face of the pump mounting plate proximate to said pump case includes a circular bore and a circular counterbore, said pump case includes a radially enlarged stabilizing ring at a pump casing end face proximate to said pump mounting plate, said pump mounting plate end face being sized to the diameter of the counterbore and receivable therein, said stabilizing ring having an end face at right angles to the first axis (x) of the cylindrical cavity within said pump case, said counterbore having a bottom face perpendicular to the axis of the bore and counterbore therein, at least one raised surface portion on the bottom face of said counterbore at the outer periphery thereof and to one side of the counterbore, and means defining said pivot axis (y) on a diametrically opposite side of said pump case from said at least one raised surface portion for contact with said stabilizing ring at the periphery of said stabilizing ring, and means for locking said stabilizing ring in a slightly tilted position along said second plane and about an axis within said first plane and at right angles to said second plane.

7. The rotary reciprocating liquid dispensing pump as claimed in claim 6, wherein said locking means comprises a plurality of cap screws having threaded shanks within respective circumferentially spaced tapped holes within said one face of said pump mounting plate and radially outside but proximate to the periphery of said counterbore, and wherein radially enlarged heads of said cap screws frictionally abut the face of said stabilizing ring to lock said stabilizing ring to said pump mounting plate in said slightly tilted position to the face of the pump mounting plate.

8. The rotary reciprocating liquid dispensing pump as claimed in claim 5, wherein said pump case is tilted along said second plane and about an axis at right angles to the second plane within said first plane at an angle of approximately 0.7°.

* * * * *